US008777881B2

(12) United States Patent
Tsai

(10) Patent No.: US 8,777,881 B2
(45) Date of Patent: Jul. 15, 2014

(54) HANDHELD MASSAGE DEVICE

(76) Inventor: Ming-Wei Tsai, Taipei Hsien (TW)

( * ) Notice: Subject to any disclaimer, the term of this patent is extended or adjusted under 35 U.S.C. 154(b) by 1305 days.

(21) Appl. No.: 12/329,392

(22) Filed: Dec. 5, 2008

(65) Prior Publication Data

US 2010/0145242 A1 Jun. 10, 2010

(51) Int. Cl.
*A61H 7/00* (2006.01)
*A61H 1/00* (2006.01)
*A61H 15/02* (2006.01)

(52) U.S. Cl.
USPC ..... 601/87; 601/80; 601/84; 601/85; 601/112

(58) Field of Classification Search
CPC ..... A61H 7/00; A61H 7/004; A61H 7/005; A61H 23/0254; A61H 23/0263; A61H 2201/1427; A61H 2201/1418
USPC ..... 601/15, 72–74, 80, 84, 87, 89, 93, 97, 601/101–117, 119–125, 129, 135–141; 607/96, 80, 88; 401/6–8; D24/211, 214
See application file for complete search history.

(56) References Cited

U.S. PATENT DOCUMENTS 1,577,751 A * 3/1926 Paschall ..... 601/112
3,710,785 A * 1/1973 Hilger ..... 601/73
4,326,314 A * 4/1982 Moret et al. ..... 15/22.1
4,336,622 A * 6/1982 Teague et al. ..... 15/22.1
4,414,963 A * 11/1983 Kunz ..... 601/134
4,730,605 A * 3/1988 Noble et al. ..... 601/110
4,733,655 A * 3/1988 Smal ..... 601/133
5,103,809 A * 4/1992 DeLuca et al. ..... 601/135
5,311,860 A * 5/1994 Doria ..... 601/103
5,336,159 A * 8/1994 Cheng ..... 601/15
5,356,369 A * 10/1994 Yamasaki et al. ..... 601/70
5,415,621 A * 5/1995 Campbell ..... 601/87
5,447,491 A * 9/1995 Bellandi ..... 601/112
6,183,429 B1 * 2/2001 Dervieux ..... 601/87
6,187,029 B1 * 2/2001 Shapiro et al. ..... 607/88
6,866,776 B2 * 3/2005 Leason et al. ..... 210/201
6,911,010 B2 * 6/2005 Dirks et al. ..... 601/15
7,128,722 B2 * 10/2006 Lev et al. ..... 601/108
7,165,285 B1 * 1/2007 Hajianpour ..... 15/28
7,270,641 B2 * 9/2007 Glucksman et al. ..... 601/112
7,775,944 B1 * 8/2010 Shultz ..... 482/92
8,062,240 B2 * 11/2011 Chiang ..... 601/98

* cited by examiner

*Primary Examiner* — Justine Yu
*Assistant Examiner* — Christopher Miller
(74) *Attorney, Agent, or Firm* — Birch, Stewart, Kolasch & Birch, LLP

(57) ABSTRACT

A handheld massage device includes an actuator mechanism and a massage unit received in an outer housing. The actuator includes a motor, a bearing and a tilting piece having a first shaft coupled with the motor and a second shaft fitted into the bearing. The crank-shaped first and second shafts do not lie on a straight line. The massage unit has a base plate and massage elements mounted on the base plate. The massage elements protrude from one end of the outer housing. The bearing is fitted in the base plate. Because the first and second shafts form an angle therebetween, the base plate is tilted and swings like a conical pendulum. Therefore, the massage elements on the base plate move back and forth along a direction of an axle of the motor, thereby providing kneading and percussion massages on the user's body.

10 Claims, 7 Drawing Sheets

HANDHELD MASSAGE DEVICE

BACKGROUND OF THE INVENTION

1. Field of the Invention

The present invention generally relates to massage devices, and more particularly to a handheld massage device providing kneading and percussion massage on various regions of a user's body.

2. The Prior Arts

A conventional handheld massage device needs to be compact in size for convenient use, so the structure of the massage device is generally very simple. The massage device usually comprises a motor axle that is driven in high speed rotation to provide high-frequency vibration. Because the conventional handheld massage device uses high-frequency vibration to massage, a prolonged use of the massage device may cause the user to feel nausea. Moreover, the conventional massage device is usually formed by multiple massage elements. If the massage device has a heating function, the heat is usually indirectly applied to the user's body through massage elements. The area of the massage elements is small so the heat is applied to body through small area, which is ineffective to promote blood circulation and relieve fatigue.

SUMMARY OF THE INVENTION

A primary objective of the present invention is to provide a handheld massage device that can massage various regions of a user's body, such as shoulders, neck, back, thighs, legs, etc.

Another objective of the present invention is to provide a handheld massage device that can provide percussion and kneading massage.

Still another objective of the present invention is to provide a handheld massage device that can provide heating in a more effective way, and includes a massage unit capable of emitting light to render a vivid visual effect.

A handheld massage device according to the present invention includes an outer housing, and an actuator mechanism and a massage unit disposed in the outer housing. The outer housing has a handle portion curving to form a hand held space. The actuator mechanism drives the massage unit to swing and has back and forth movement, thereby providing kneading and patting massage on the user's body.

The actuator mechanism includes a motor coupled with a crank-shaped tilting piece. The tilting piece has a first shaft coupled with the motor and a second shaft fitted into a bearing. The first and second shafts of the tilting piece form an angle therebetween. Therefore, the massage unit coupled with the actuator mechanism is tilted. Consequently, massage elements on the tilting massage unit swing and has an effect of moving back and forth. Therefore, the massage device provides kneading and patting massage actions.

Moreover, the massage unit may include a lamp circuit and a thermal resistor. During operation, the massage elements emitting light and heat on the user's body. The massage device may have a single planar shape massage element or three massage elements to produce a face-to-face heating.

Furthermore, another advantage of the massage device is its convenient gripping and operation, suitable for applying massage on various regions of the body. Through the tilting piece, the massage elements can perform swing and up-and-down movements to produce kneading and patting massage. Further, as the contact surface between the massage element and the user's body is increased, the massage can be applied on a larger area and the user is able to feel the heating in a more effective manner. During operation, the massage element also emits vivid light, improving the aesthetic appearance of the massage device.

BRIEF DESCRIPTION OF THE DRAWINGS

The present invention will be apparent to those skilled in the art by reading the following detailed description of a preferred embodiment thereof, with reference to the attached drawings, in which.

DETAILED DESCRIPTION OF THE PREFERRED EMBODIMENTS

Figure 1:
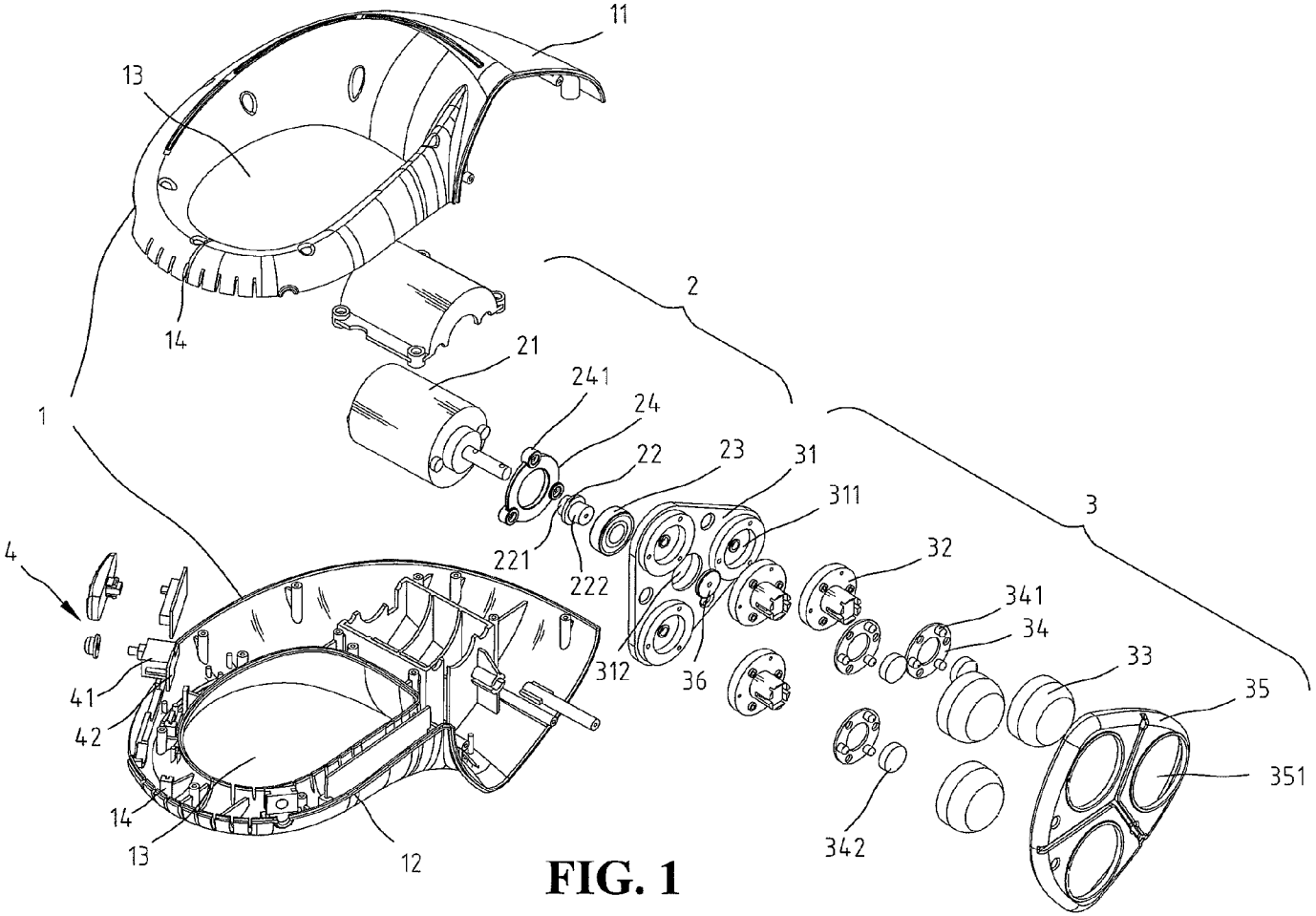
FIG. 1 is an exploded view showing a handheld massage device according to a first embodiment of the present invention.

FIG. 1 is an exploded view of a handheld massage device according to a first embodiment of the present invention. The massage device comprises an outer housing 1 in which are mounted an actuator mechanism 2, a massage unit 3 and an electric controller 4. The actuator mechanism 2 drives the massage unit 3 to swing with back and forth movement effect for massaging a user's body.

The outer housing 1 is formed by assembling an upper cover 11 and a lower cover 12. The outer housing 1 includes a handle portion 14 to be grasped by a hand. The handle portion 14 curves to form a hand held space 13. The actuator mechanism 2 comprises a motor 21, a tilting piece 22, a bearing 23, and a securing collar 24 provided with a plurality of small protrusions 241. Referring to FIG. 3A, the tilting piece 22 has a central disk, a first shaft 221 close to the motor 21 and a second shaft 222 away from the motor 21. Both side surfaces of the central disc are not parallel to each other. Instead, one of the side surfaces is slanted. The first shaft 221 and the second shaft 222 of the tilting piece 22 are perpendicular to the side surfaces, respectively. Therefore, the first shaft 221 and the second shaft 222 of the tilting piece 22 do not lie on a straight line and form an angle therebetween. The massage unit 3 comprises a base plate 31. The base plate 31 according to the first embodiment is triangular and a through-hole 312 is disposed at a center of the base plate 31. A side surface of the base plate 31 away from the motor 21 is provided with a plurality of circular fitting slots 311 surrounding the through-hole 312. The massage unit 3 includes a plurality of step-shaped support seats 32 corresponding to the fitting slot 311. A plurality of dome-shaped massage elements 33 is also provided. In addition, a plurality of lamp circuits 34 is provided and each of the lamp circuits 34 includes an annular circuit board. A plurality of lamps 341 and thermal resistors 342 is mounted on and electrically connected with the lamp circuits 34. The lamps 341 can be light-emitting diodes (LED) or miniature lamps. The massage unit 3 also comprises an outer lid 35 whose shape is corresponding to the base plate 31. The outer lid 35 has a plurality of restricting openings 351 corresponding to the massage elements 33. The electric controller 4 is electrically connected with the lamp circuits 34. The electric controller 4 includes a circuit board 42 coupled with a power switch 41. The circuit board 42 may also include push buttons or rotary knobs for adjusting the light intensity of the lamps or the temperature of the thermal resistors.

Referring to FIGS. 1-3A, when assembling the massage device, the motor 21 is mounted in the lower cover 12. The securing collar 24 is placed around an axle of the motor 21. The axle of the motor 21 is fitted into the first shaft 221 of the tilting piece 22 and the second shaft 222 of the tilting piece 22 is fitted in the bearing 23. A first end of the bearing 23 is securely clipped between the protrusions 241 of the securing collar 24 and a second end of the bearing 23 is fitted in the through-hole 312 of the base plate 31. Then the base plate 31 is connected with the securing collar 24 by the protrusions 241. Thus, the bearing 23 is restrictedly positioned between the securing collar 24 and the base plate 31. A cap 36 seals the through-hole 312 and thus prevents the bearing 23 from disengaging from the through-hole 312. Because the first shaft 221 and the second shaft 222 of the tilting piece 22 do not lie in a straight line, the base plate 31 is not perpendicular to the axle of the motor 21. Each of the support seats 32 is securely mounted in the fitting slot 311 of the base plate 31. The lamp circuit 34 is locked in position on the step-shaped support seat 32, and accommodates the lamps 341 and thermal resistors 342 therein. The outer lid 35 is securely snap-fitted on the base plate 31 with each of the massage elements 33 correspondingly protruding through the restricting openings 351. Ultimately, the upper cover 11 and the lower covers 12 are fixedly assembled. The upper cover 11, the lower covers 12 and the handle portion 14 form the hand held space 13. The electric controller 4 can be mounted in the handle portion 14 or the outer housing 1, whereas the power switch 41 and like buttons protrude from the handle portion 14. The outer lid 35 and massage elements 33 are located at an end of the outer housing 1 away from the handle portion 14.

Figure 4:
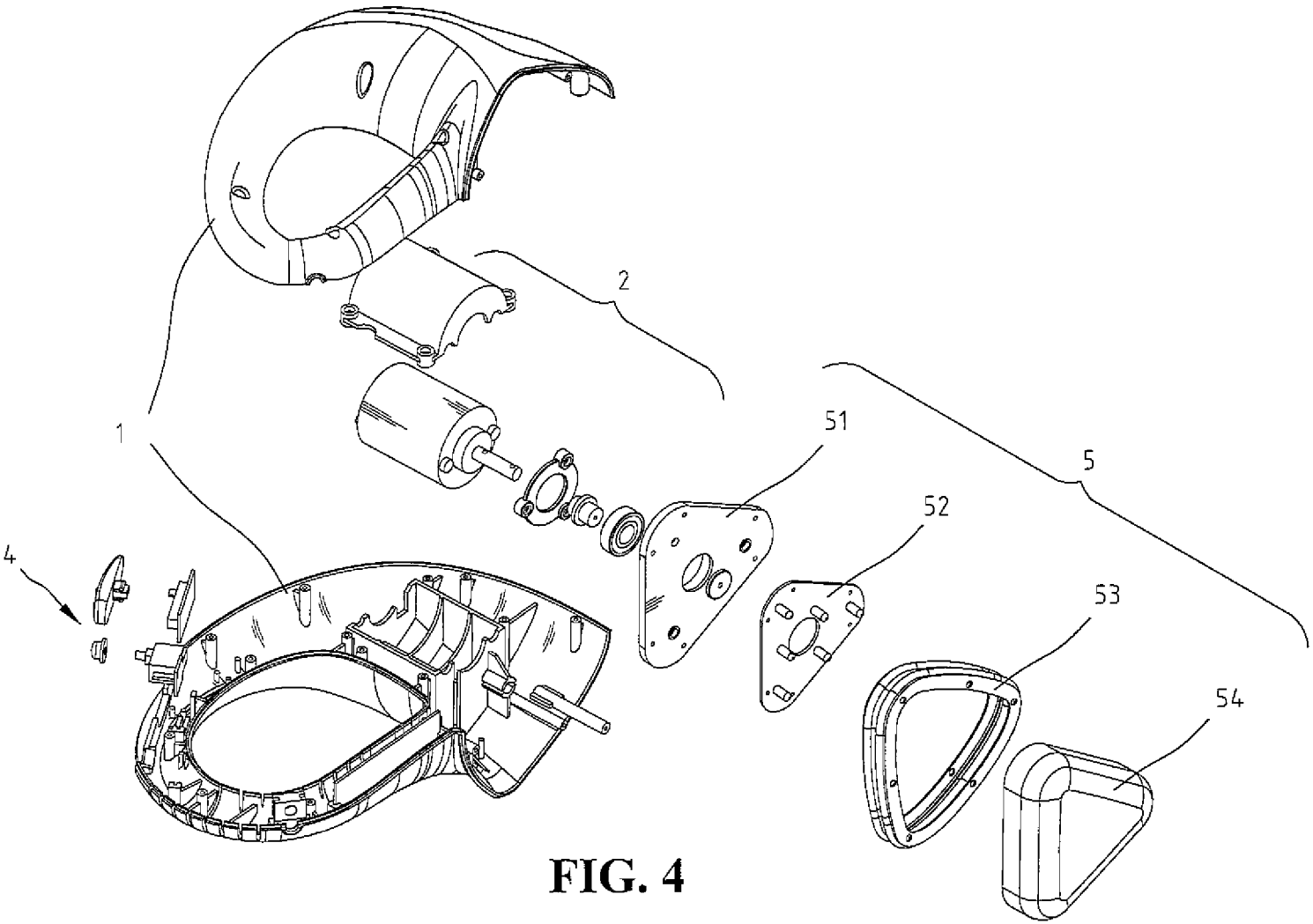
FIG. 4 is an exploded view showing the handheld massage device according to a second embodiment of the present invention.
Figure 5:
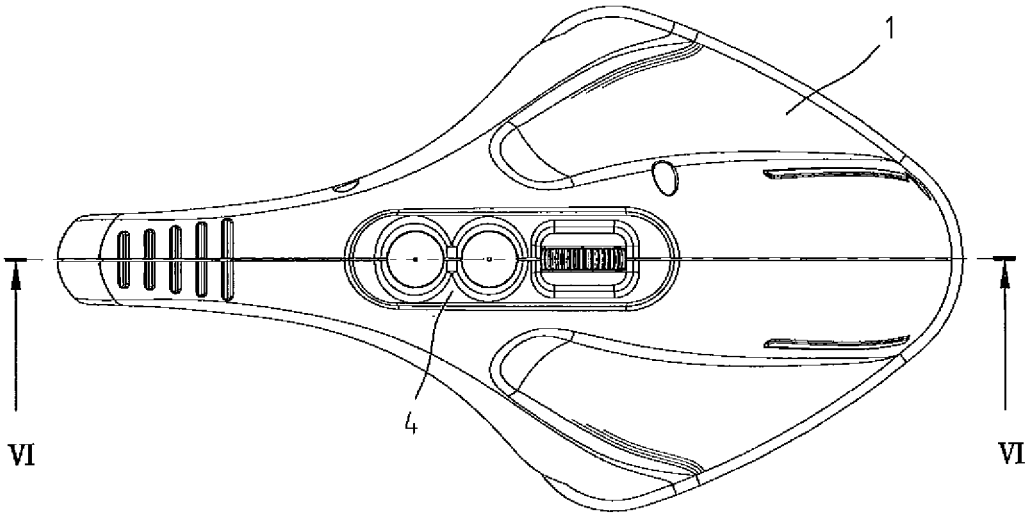
FIG. 5 is a top view of the handheld massage device according to the second embodiment of the present invention.
Figure 6:
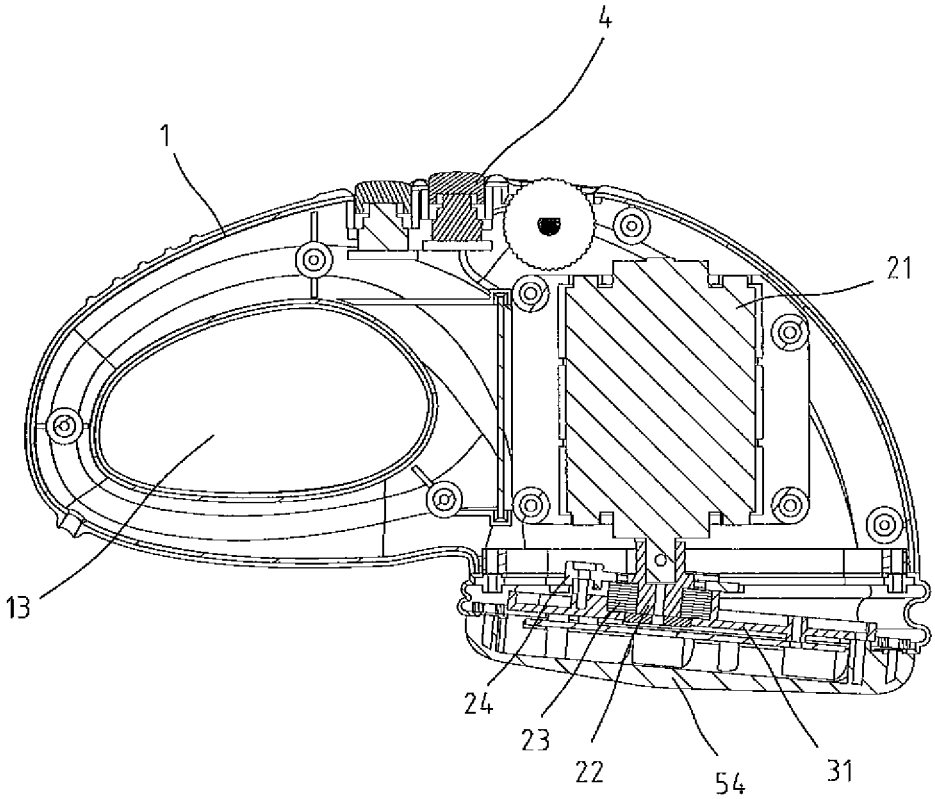
FIG. 6 is a cross-sectional view taken along section line VI-VI shown in FIG. 5.

Referring to FIGS. 4 to 6, a handheld massage device according to a second embodiment of the present invention includes a massage unit 5. The massage unit 5 includes a base plate 51 on which a lamp circuit board 52 having a shape matched therewith is mounted. Moreover, the support seat 53 is formed as a contour frame corresponding to a contour of the base plate 51, whereas the massage element 54 is configured as a planar cover corresponding to the shape of the frame 53. When assembling the massage unit 5, the lamp circuit board 52 is secured on the inner edge of the support seat 53. The massage element 54 is assembled on a side of the support seat 53, whereas the base plate 51 is securely mounted on an opposite side of the support seat 53. The other component parts, such as the outer housing 1, the actuator mechanism 2, and the electric controller 4 are assembled in the same way as the first embodiment.

Figure 2:
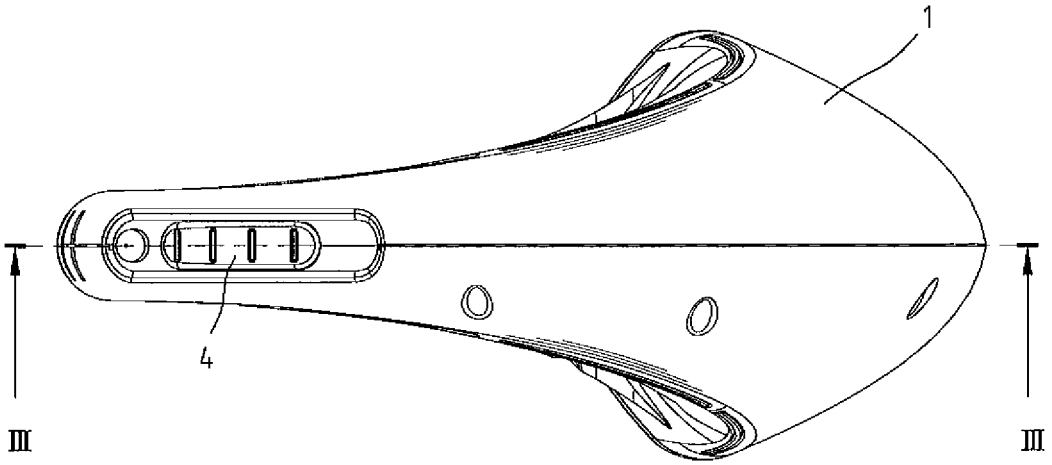
FIG. 2 is a top view showing the handheld massage device according to the first embodiment of the present invention.
Figure 3:
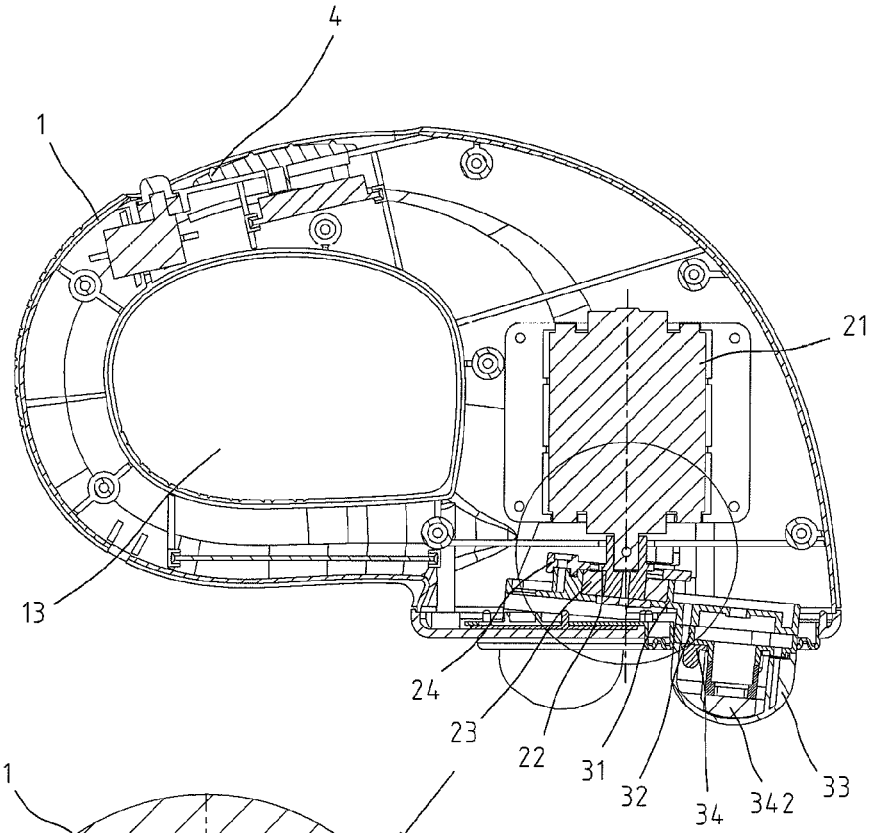
FIG. 3 is a cross-sectional view taken along section line III-III shown in FIG. 2.
Figure 3A:
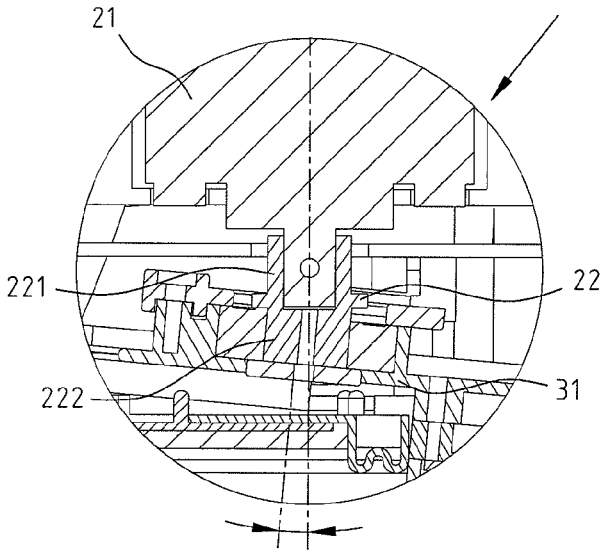
FIG. 3A is a detailed view showing a tilting piece according to the present invention.

Referring to FIGS. 3 and 3A, the tilting piece 22 is coupled with the bearing 23 and the bearing 23 is coupled with the base plate 31. The first shaft 221 and the second shaft 222 of the tilting piece 22 are crank-like. The first shaft 221 of the tilting piece 22 is in the vertical direction and the second shaft 222 of the tilting piece 22 is slightly slanted in the upper-right to lower-left direction. The bearing 23 and the base plate 31 are not perpendicular to the axle of the motor 21. Instead, the bearing 23 and the base plate 31 is in the upper-left to lower-right direction, and the massage element 33 at the right side is located at a lowest position as shown in FIG. 3. When the power switch 41 of the handheld massage device is pressed down, the activated motor 21 drives the tilting piece 22 in rotation. The rotating tilting piece 22 drives the bearing 23 and the base plate 31 to swing like a conical pendulum. The second shaft 222 of the tilting piece 22 works like the string of the conical pendulum, and the bearing 23 and the base plate 31 work like the mass of the conical pendulum. The slanted bearing 23 and the base plate 31 move in a circle perpendicular to the axle of the motor 21. When the tilting piece 22 rotates 180 degrees, the bearing 23 and the base plate 31 swing to lie in the upper-right to lower-left direction. However, the base plate 31 is coupled with an outer portion of the bearing 23. The outer portion of the bearing 23 and the base plate 31 do not rotate. After the base plate 31 swings from the upper-left-to-lower-right direction to the upper-right-to-lower-left direction, the massage element 33 at the right side is still located at the right side but moves from the lowest position to a highest position. Therefore, the massage element 33 moves up and down to provide percussion massage. The base plate 31 swings like a conical pendulum and thus the massage elements 33 provide kneading massage. When the power of the handheld massage device is on, the lamps 241 also illuminate to enhance the aesthetics of the massage device and the thermal resistors 342 irradiate heat to relieve the muscle soreness. Referring to FIG. 6, the handheld massage device according to the second embodiment functions in the same way to the handheld massage device according to the first embodiment as shown in FIGS. 1-3.

Figure 7:
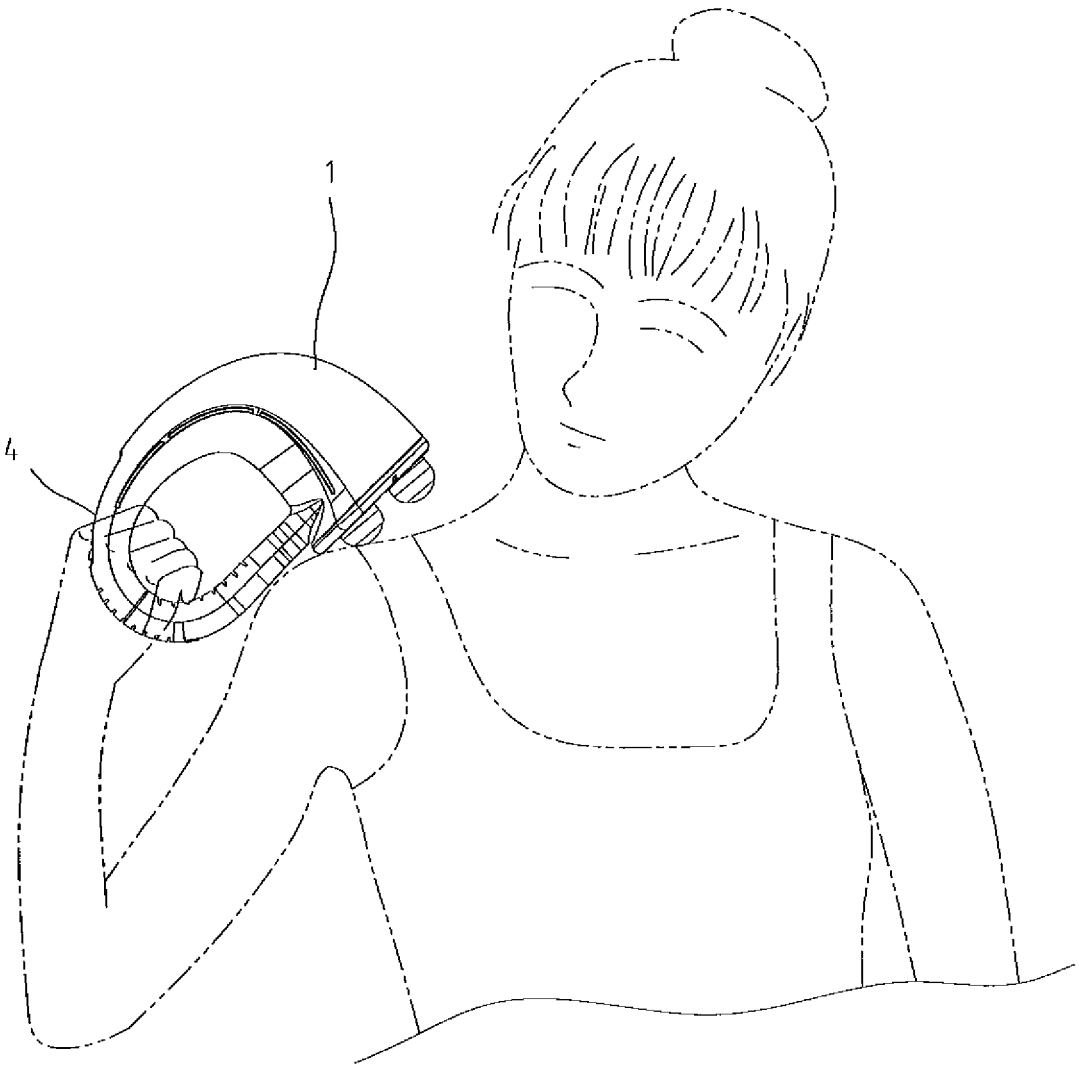
FIG. 7 is a schematic view showing a use configuration of the handheld massage device according to the first embodiment of the present invention.

FIG. 7 is a schematic view illustrating the massage device according to the first embodiment is used to massage the user's shoulder. The massage device may be adapted to massage on any portions of a user's body, such as a user's back, neck, shoulders, arms, thighs, legs, etc. Through the tilted massage unit 3, the massage elements 33 move back and forth and thus the massage device provides patting and kneading massage on the user's body. The massage device does not use high-frequency vibration to massage. Nausea feeling during massage can thus be prevented. Further, when the massage device is powered on, the lamp circuit 34 is also activated to cause the lamps 341 to illuminate and the thermal resistors 342 to irradiate heat. In addition, as the massage elements 33 may be made of a transparent material or a translucent material, light emitted from the lamp 341 can be amplified and scattered through the massage elements 33 to provide a vivid light effect. The massage device is thus capable of not only emitting light but also applying a heating on the user's body. In particular, the planar massage element 54 of the second embodiment is a single piece and provides a larger area to apply a heating in a more effective manner for relieving fatigue and improving blood circulation.

Although the present invention has been described with reference to the preferred embodiment thereof it is apparent to those skilled in the art that a variety of modifications and changes may be made without departing from the scope of the present invention which is intended to be defined by the appended claims.

What is claimed is:

1. A handheld massage device, comprising:

an outer housing having a handle portion, the handle portion curving to form a hand held space;

an actuator mechanism disposed in the outer housing and comprising a motor, a bearing and a tilting piece, wherein the tilting piece has a first shaft coupled with the motor and a second shaft fitted in the bearing, and a center axis of the first shaft and a center axis of the second shaft are offset to form a tilting angle therebetween, and wherein the center axis of the first shaft intersects the center axis of the second shaft;

a massage unit coupled with the actuator mechanism and including a base plate, wherein the bearing is coupled with the base plate, at least one massage element is mounted on the base plate, the massage element is exposed out of an end of the outer housing, the base plate is not perpendicular to an axle of the motor and is tilted with an angle;

an electric controller having a circuit board disposed in the outer housing and a switch disposed outside of the outer housing, wherein the switch coupled with the circuit board and the motor is electrically connected with the circuit motor is electrically connected with the circuit board; and at least one support seat disposed on the base plate for assembling the massage element, wherein the massage unit further comprises an outer lid coupled with the base plate, and the support seat and the massage elements are disposed between the base plate and the outer lid.

2. The handheld massage device according to claim 1, wherein a lamp circuit having a thermal resistor is disposed between the base plate and the massage element, and the lamp circuit is electrically connected with the electric controller.

3. The handheld massage device according to claim 1, wherein a thermal resistor electrically connected with the electric controller is disposed between the base plate and the massage element.

4. The handheld massage device according to claim 1, wherein the support seat is formed as a contour frame corresponding to a contour of the base frame.

5. The handheld massage device according to claim 4, wherein the massage element is a cover disposed on the contour frame.

6. The handheld massage device according to claim 5, wherein the massage element is a planar cover.

7. The handheld massage device according to claim 1, wherein the support seat has a stepped shape.

8. The handheld massage device according to claim 7, wherein the massage element has a round protruding shape.

9. The handheld massage device according to claim 8, wherein the outer lid is provided with a plurality of restricting openings corresponding to the massage elements, and the massage elements protrude through the corresponding restricting openings.

10. The handheld massage device according to claim 1, wherein the tilting piece is formed as a single piece, and the first and second shafts form a continuous channel extending through the first and second shafts.

* * * * *